US005441139A

United States Patent [19]

Abe et al.

[11] Patent Number: 5,441,139

[45] Date of Patent: Aug. 15, 1995

[54] COIN SORTING DEVICE IN WHICH UNNECESSARY MATERIAL CAN BE READILY REMOVED FROM A SORTING PASSAGE

[75] Inventors: Hiroshi Abe, Tokyo; Yoshinobu Tanaka, Saitama, both of Japan

[73] Assignee: Asahi Seiko Kabushiki Kaisha, Tokyo, Japan

[21] Appl. No.: 157,459

[22] Filed: Nov. 26, 1993

Related U.S. Application Data

[62] Division of Ser. No. 943,288, Sep. 10, 1992, Pat. No. 5,293,981.

[30] Foreign Application Priority Data

| | | | |
|---|---|---|---|
| Sep. 11, 1991 | [JP] | Japan | 3-95942 U |
| Sep. 11, 1991 | [JP] | Japan | 3-95943 U |
| Sep. 11, 1991 | [JP] | Japan | 3-95944 U |
| Nov. 27, 1991 | [JP] | Japan | 3-111531 |
| Feb. 28, 1992 | [JP] | Japan | 3-23240 U |

[51] Int. Cl.[6] ..... G07D 3/04; G07F 1/04

[52] U.S. Cl. ..... 194/347; 453/9

[58] Field of Search ..... 194/202, 335, 339, 340, 194/344, 345, 347, 348, 349; 453/9, 14, 15

[56] References Cited

U.S. PATENT DOCUMENTS

| | | | |
|---|---|---|---|
| 3,837,454 | 9/1974 | Joeck | 194/344 X |
| 5,090,548 | 2/1992 | Hird et al. | 194/345 |

FOREIGN PATENT DOCUMENTS

| | | | |
|---|---|---|---|
| 2-282888 | 11/1990 | Japan | 194/344 |
| 925093 | 5/1963 | United Kingdom | 194/344 |
| 2250620 | 6/1992 | United Kingdom | 194/344 |

*Primary Examiner*—F. J. Bartuska

*Attorney, Agent, or Firm*—Hopgood, Calimafde, Kalil & Judlowe

[57] ABSTRACT

In a coin sorting device which rolls a coin along a sorting passage and which carries out a sorting operation for the coin during movement of the coin, it is readily possible to remove unnecessary material from the sorting passage. The unnecessary material may be surface material which is separated from the coin. If the unnecessary material is left in the sorting passage, it becomes one of factors which cause an error in the sorting operation. Inasmuch as the unnecessary material can be readily removed from the sorting passage, reliability is improved as regards the sorting operation. For removing the unnecessary material, a plurality of through holes may be made to a bottom of the sorting passage. A roller member may be used at the bottom of the sorting passage instead of making the through holes.

10 Claims, 10 Drawing Sheets

COIN SORTING DEVICE IN WHICH UNNECESSARY MATERIAL CAN BE READILY REMOVED FROM A SORTING PASSAGE

This application is a division of application Ser. No. 07/943,233, filed Sep. 10, 1992, now U.S. Pat. No. 5,293,981.

BACKGROUND OF THE INVENTION

This invention relates to a coin sorting device for use in an automatic vending machine, a coin operated gaming machine, or the like.

Various coin sorting devices of the type are already known. For example, a coin sorting device is disclosed in Japanese patent application laid-open publication No. 58489/1991. The coin sorting device includes a sorting passage defined between a stationary side plate and a movable side plate which is openably connected to and spaced to the stationary side plate. The sorting passage is supplied with a normal coin or a token coin. The normal coin, the token coin, and the like will collectively be called hereinunder a coin. The coin has a coin diameter.

In the manner known in the art, the coin sorting device carries out a sorting operation for the coin with reference the coin diameter and others. The sorting operation is, for example, separating various coins into an acceptable and a nonacceptable coin. In this event, the coin is moved along the sorting passage with rotation thereof.

It is assumed that the coin is soiled with dust, oil, and others which are attached on a surface thereof and which will be called surface material. The surface material has a part which is separated from the coin during movement of the coin along the sorting passage and is left as unnecessary material in the sorting passage. The unnecessary material becomes one of factors which cause an error in the sorting operation.

Therefore, it is necessary to often carry out a cleaning operation of the sorting passage. It is, however, difficult and necessary much time to carry out the cleaning operation. This is because the sorting passage is very narrow.

SUMMARY OF THE INVENTION

It is therefore an object of this invention to provide a coin sorting device in which unnecessary material can be readily removed from a sorting passage.

It is another object of this invention to provide a coin sorting device of the type described, in which the unnecessary material is discharged from the sorting passage.

It is still another object of this invention to provide a coin sorting device of the type described, in which it is possible to carry out a cleaning operation of the coin sorting device.

Other objects of this invention will become clear as the description proceeds.

According to this invention, there is provided a coin sorting device comprising passage defining means for defining a sorting passage which extends in a predetermined direction and which is supplied with a coin. The passage defining means moves the coin along the sorting passage. The coin sorting device further comprises sorting means connected to the passage defining means for carrying out a sorting operation for the coin during movement of the coin, and removing means connected to the passage defining means for removing unnecessary material from the sorting passage.

DESCRIPTION OF THE PREFERRED EMBODIMENTS

Figure 1:
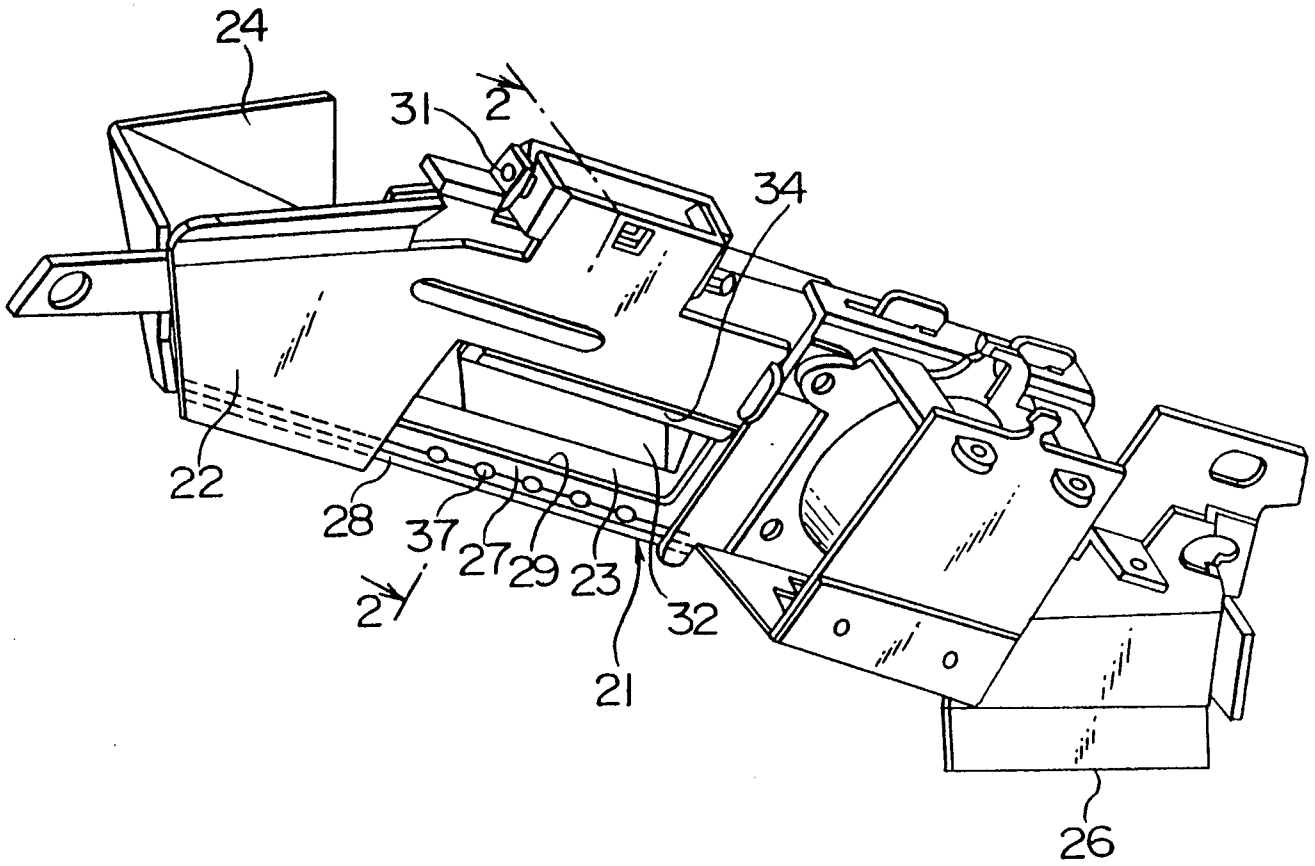
FIG. 1 is a perspective view of a coin sorting device according to a first embodiment of this invention.
Figure 2:
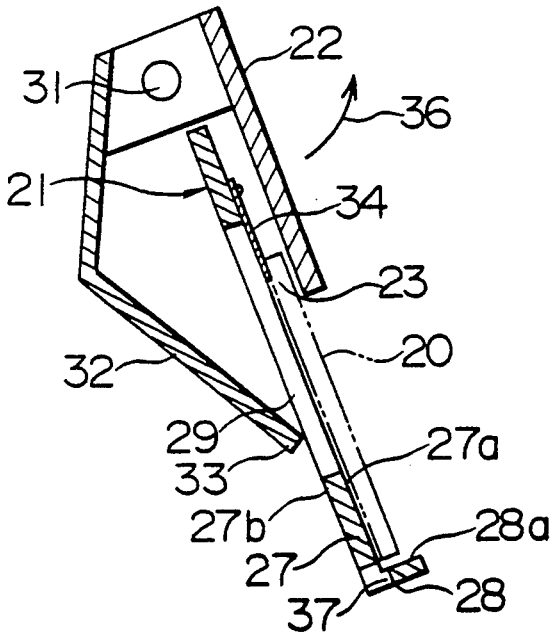
FIG. 2 is a sectional view of the coin sorting device taken along a line 2—2 in FIG. 1.

Referring to FIGS. 1 and 2, a coin sorting device according to a first embodiment of this invention is for sorting a coin 20 and, more particularly, for separating various coins into an acceptable and a nonacceptable coin in the manner which will later be clear. The coin 20 has opposite end surfaces and a coin peripheral surface extending between the opposite end surfaces. The coin sorting device comprises a stationary guiding member 21 and a movable plate 22 which are for defining a sorting passage 23 therebetween. The sorting passage 23 extends in a predetermined direction which inclines relative to a horizontal direction. The sorting passage 23 has inlet and outlet portions 24 and 26 at both ends thereof in the predetermined direction, respectively. A combination of the stationary guiding member 21 and the movable plate 22 is referred to as a passage defining arrangement.

The stationary guiding member 21 comprises a side portion 27 for defining one of sides of the sorting passage 23 and a bottom portion 28 for defining a bottom of the sorting passage 23. The side portion 27 inclines relative to a vertical plane and has a side receiving surface **27*a*, a side back surface 27*b*, and a large aperture 29 which extends in the predetermined direction. The bottom portion 28 is formed integral with the side portion 27 to make a right angle with the side receiving surface 27*a* and has bottom receiving and bottom back surfaces 28*a* and 28*b*. Each of the side and the bottom receiving surfaces 27*a* and 28*a*** extends in the predetermined direction.

The movable plate 22 is opposite to the side receiving surface **27*a* of the side portion 27 with a predetermined gap left therebetween. The predetermined gap has a size slightly greater than that between the opposite end surfaces of the coin 20. The movable plate 22 has an upper portion pivotally supported to the stationary guiding member 21 through a hinge portion 31**.

The coin sorting device further comprises a rejecting arm 32 fixed to the movable plate 23. The rejecting arm 32 is for rejecting the coin 20 in the manner known in the art. The rejecting arm 32 extends to face the side back surface 27*b* and has an arm end portion 33 facing the large aperture 29.

The coin sorting device further comprises a sorting plate 34 detachably attached to an upper part of the side portion 27. The sorting plate 34 extends along the side receiving surface 27*a* of the side portion 27 to face an upper area of the large aperture 29. The sorting plate 34 serves to carry out a sorting operation for the coin 20 with reference to a coin diameter of the coin 20 in the manner known in the art.

The sorting operation is carried out in the manner known in the art and will therefore be shortly described in the following.

When supplied to the sorting passage 23 through the inlet portion 24, the coin 20 is deposited on the stationary guiding member 21 as depicted by a chain line in FIG. 2. The coin 20 roll on the bottom receiving surface 28*a* in the predetermined direction. In other words, the stationary guiding member 21 moves the coin 20 along the sorting passage 23 with rotation of the coin 20. In this event, a selected one of the opposite end surfaces of the coin 20 slides on the side receiving surface 27*a* of the side portion 27.

In a case where the coin diameter of the coin 20 is greater than a predetermined diameter, the coin 20 continuously roll on the bottom receiving surface 28*a* with upper and lower portions thereof received on the sorting plate 34 and the side portion 27, respectively. As a result, the coin 20 reaches to the outlet portion 26 and discharged as the above-mentioned acceptable coin therefrom in the manner known in the art.

In another case where the coin diameter of the coin is smaller than the predetermined diameter, the upper portion of the coin 20 is not received by the sorting plate 34. Therefore, the coin 20 further inclines to make the upper portion thereof pass through the large aperture 29. As a result, the coin 20 is stopped in the sorting passage 21.

In order to reject the coin 20 from the sorting passage 21, it is possible to carry out a rejecting operation, for example, operating of a push button or a return lever (not shown). Responsive to the rejecting operation, the movable plate 22 is moved around the hinge portion 31 as indicated by an arrow mark 36. Together with the movable plate 22, the rejecting arm 32 is also moved to make the arm end portion 33 push the coin 20 in a specific direction which is perpendicular to the side receiving surface 27*a*. As a result, the coin 20 is rejected as the above mentioned nonacceptable coin from the sorting passage 21. The nonacceptable coin is sent to a return opening (not shown).

In the manner discussed above, it is assumed that unnecessary material is left in the sorting passage 21. For removing the unnecessary material from the sorting passage 21, the stationary guiding member 21 has a plurality of through holes 37 as a removing arrangement. The through holes 37 are made at a corner portion between the side and the bottom portions 27 and 28. In other words, each of the through holes 37 is made to extend from the bottom portion 28 to the side portion 27. Each of the through holes 37 has a hole diameter which is extremely smaller than the coin diameter. It is to be noted that the through holes 37 are placed at least a sorting position at which the coin 20 is subjected to the sorting operation.

According to this structure, the unnecessary material is discharged or readily removed from the sorting passage 23 through the through holes 37 at the sorting position. As a result, the unnecessary material is reduced at the sorting position.

A net-shaped member may be sued as the removing arrangement at the sorting position instead of making the through holes 37.

Figure 4:
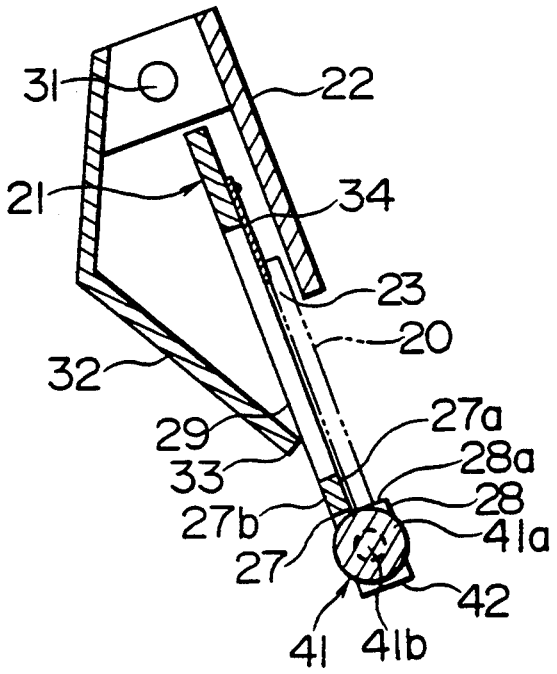
FIG. 4 is a sectional view of the coin sorting device taken along a line 4—4 in FIG. 3.
Figure 3:
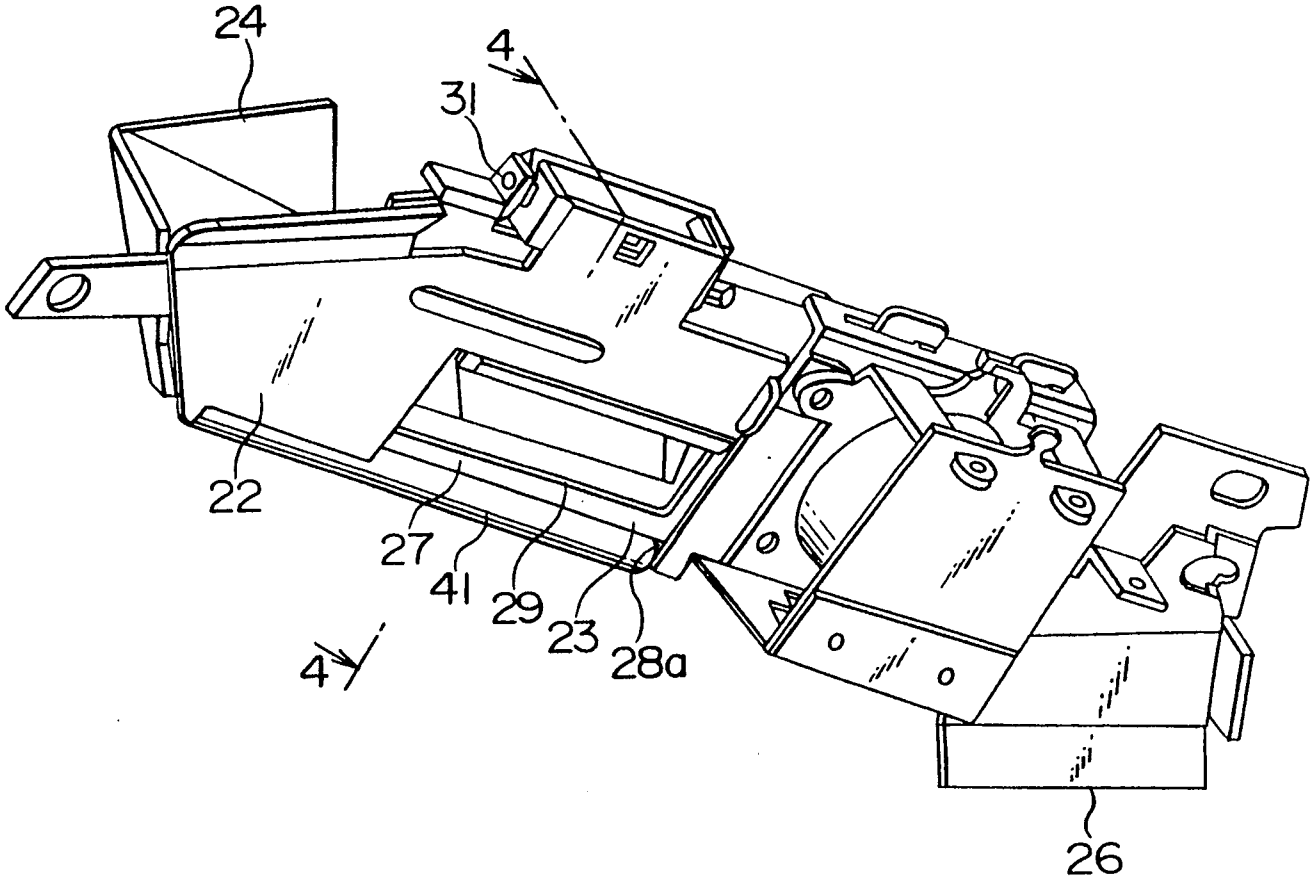
FIG. 3 is a perspective view of a coin sorting device according to a second embodiment of this invention.

Turning to FIGS. 3 and 4, the description will proceed to a coin sorting device according to a second embodiment of this invention. The coin sorting device comprises similar parts designated by like reference numerals.

The coin sorting device further comprises a bottom roller member 41 connected to the bottom portion 28. The bottom roller member 41 has a bottom roller axis extending in the predetermined direction and a bottom roller peripheral surface surrounding the bottom roller axis. The bottom roller member 41 is rotatable around the bottom roller axis. It is to be noted that the bottom roller peripheral surface has an upper part flushing with the bottom receiving surface 28*a*.

More particularly, the bottom roller member 41 is made of a metallic material and comprises a large diameter portion 41 and two small diameter portions 41*b* formed integral with both axial ends of the large diameter portion 41*a*. The bottom portion 28 has a pair of supporting plates 42. The small diameter portions 41*b* are rotatably supported to the supporting plates 42, respectively.

When supplied to the sorting passage 23 through the inlet portion 24, the coin 20 rolls on the bottom roller member 41 in the predetermined direction. In this event, the unnecessary material drops down from the bottom roller member 41.

It is assumed that the unnecessary material adheres to the roller peripheral surface of the bottom roller member 41. It is, however, readily possible to clean the bottom roller member 41 at an outside of the sorting passage 23. This is because the bottom roller member 41 is rotatable around the bottom roller axis.

Figure 5:
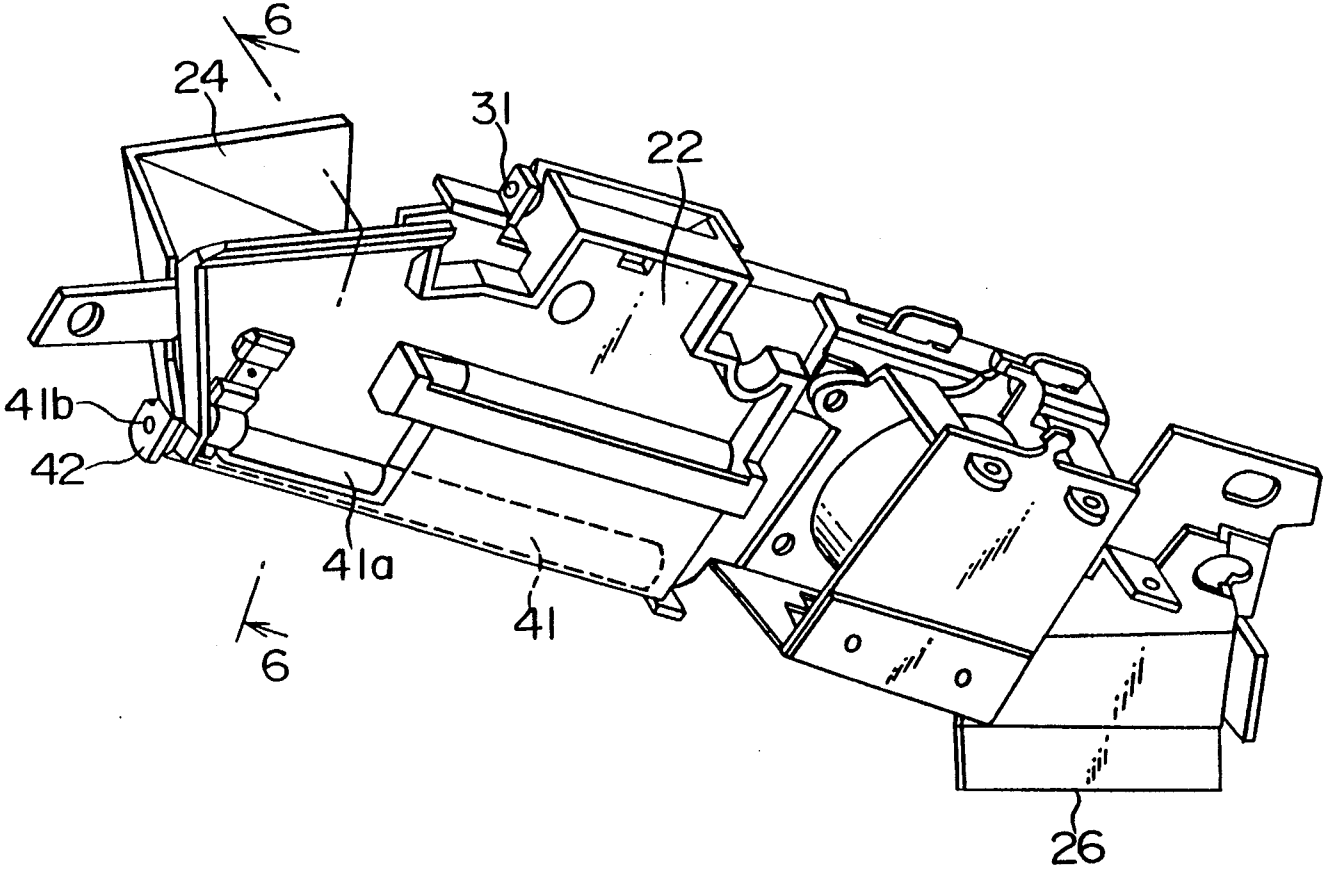
FIG. 5 is a perspective view of a coin sorting device according to a third embodiment of this invention.
Figure 6:
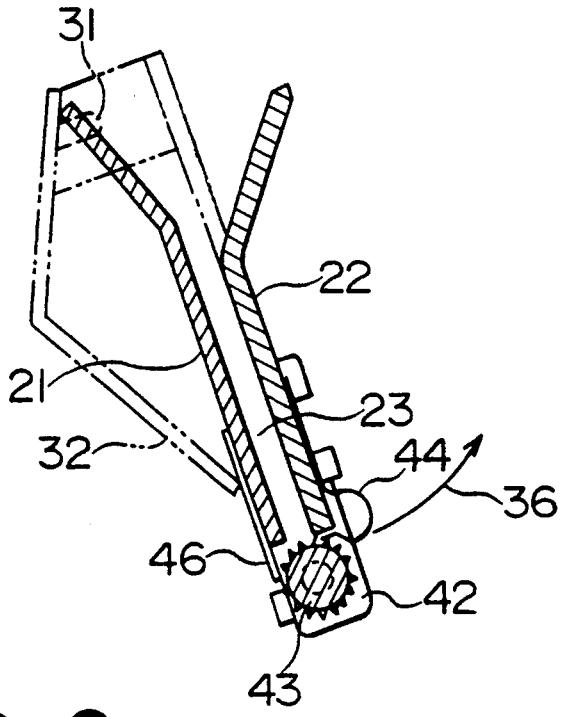
FIG. 6 is a sectional view of the coin sorting device taken along a line 6—6 in FIG. 5.

Turning to FIGS. 5 and 6, the description will proceed to a coin sorting device according to a third embodiment of this invention. The coin sorting device comprises similar parts designated by like reference numerals.

The coin sorting device further comprises a ratchet wheel 43 and a pawl 44. The ratchet wheel 43 is connected to the bottom roller member 41. The pawl 44 is held to the movable plate 22 and is for rotating the ratchet wheel 43 as will later be described in detail. The bottom roller member 41 is rotated in accordance with rotation of the ratchet wheel 43.

When the rejecting operation is carried out in the manner described above, the movable plate 22 is moved around the hinge portion 31 as indicated by the arrow mark 36 and carries the pawl 44. At this time, the pawl 44 is separated from the ratchet wheel 43. A combination of the ratchet wheel 43 and the pawl 44 will be referred to as a rotating arrangement.

When the rejecting operation becomes to an end, the movable plate 22 returns back to its original position which is illustrated in FIG. 6. Simultaneously, the pawl 44 becomes in engagement with the ratchet wheel 43 to make the ratchet wheel 43 rotate only a predetermined angle in a counterclockwise direction in FIG. 6.

The coin sorting device further comprises a leaf spring member 46 connected to the side portion 27. The leaf spring member 46 is for preventing the ratchet wheel 43 from clockwise rotation thereof in FIG. 6. As a result, the bottom roller member 41 is prevented from the clockwise rotation thereof. A combination of the bottom roller member 41 and the leaf spring member 46 will be referred to as a rotation preventing arrangement.

Figure 7:
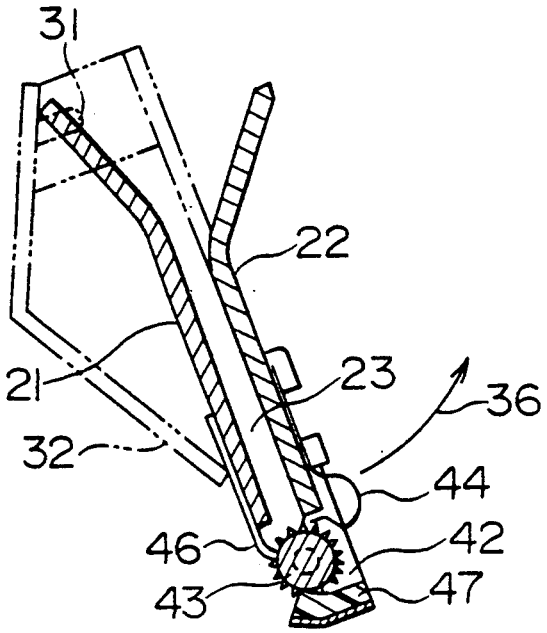
FIG. 7 is a sectional view of a first modification of the coin sorting device of FIG. 5.

Turning to FIG. 7, the description will proceed to a first modification of the coin sorting device of FIG. 5. The first modification comprises similar parts designated by like reference numerals.

The first modification further comprises a scraping member 47 held between the supporting plates 42. The scraping member 47 extends in the predetermined direction and is for scraping the unnecessary material from the bottom roller peripheral surface of the bottom roller member 41. The scraping member 47 is made of felt.

Figure 8:
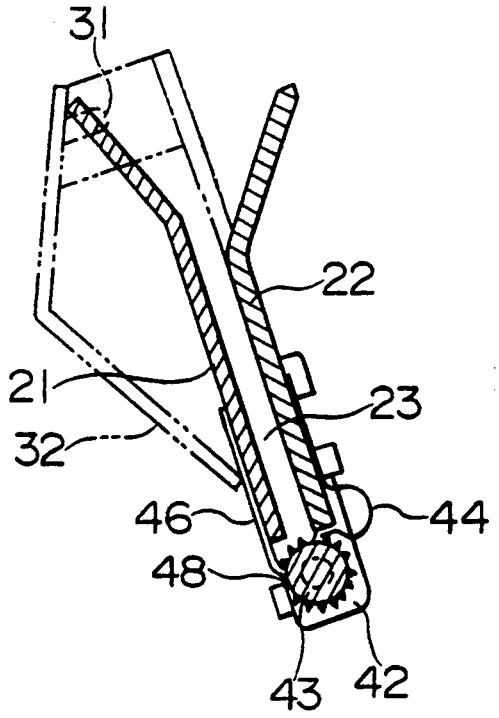
FIG. 8 is a sectional view of a second modification of the coin sorting device of FIG. 5.

Turning to FIG. 8, the description will proceed to a second modification of the coin sorting device of FIG. 5. The second modification comprises similar parts designated by like reference numerals.

The second modification further comprises a modified scraping member 48 instead of the first-mentioned scraping member 47. The modified scraping member 48 is made of a spring material and is held between the supportion plates 42. The modified scraping member 48 has an edge which is brought in press contact with the bottom roller peripheral surface of the bottom roller member 41. The edge of the modified scraping member 48 serves to scrape the unnecessary material from the bottom roller peripheral surface when the bottom roller member 41 is rotated.

Figure 9:
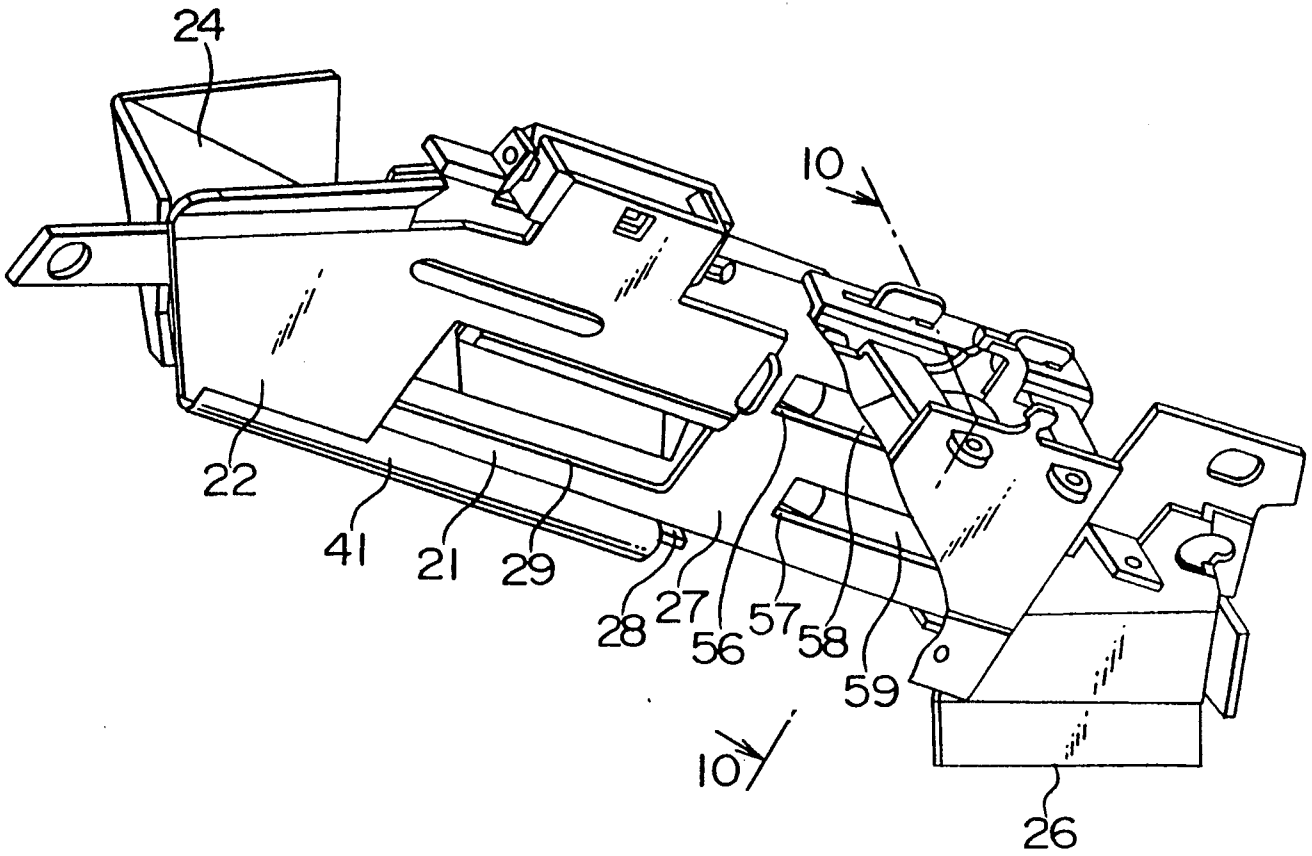
FIG. 9 is a perspective view of a coin sorting device according to a fourth embodiment of this invention, a part of which being cut off.
Figure 10:
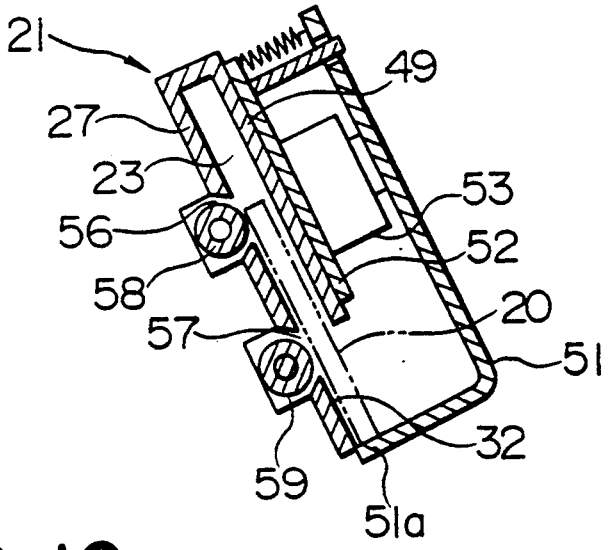
FIG. 10 is a sectional view of the coin sorting device taken along a line 10—10 in FIG. 9.

Turning to FIGS. 9 and 10, the description will proceed to a coin sorting device according to a fourth embodiment of this invention. The coin sorting device comprises similar parts designated by like reference numerals.

The stationary guiding plate 21 further comprises an additional portion 49 which is opposite to the side portion 27 with the above-mentioned predetermined gap. The coin sorting device further comprises an L-shaped plate 51, an active plate 52, and an electromagnet 53 as follows.

The L-shaped plate 51 is fixedly secured to the stationary guiding plate 21 and has a leg portion 51*a* which is adjacent to the bottom portion 28 in the predetermined direction for guiding the coin 20. The active plate 52 is movable in the specific direction and connected to the movable plate 22. The electromagnet 53 is connected to the L-shaped and the active plates 51 and 52 and is for moving the active plate 52 in response to a signal which is supplied to the electromagnet 53 for the rejecting operation. In accordance with movement of the active plate 52, the movable plate 22 is moved to carry out the rejecting operation in the manner described above.

The side plate 27 has first and second windows 56 and 57 which extend in the predetermined direction. The coin sorting device further comprises first and second side roller members 58 and 59 which are placed at the first and the second window 56 and 57, respectively. Each of the first and the second side roller members 58 and 59 has a side roller axis and a side roller peripheral surface surrounding the side roller axis and is connected to the side portion 27 to be rotatable around the side roller axis. It is to be noted that the side roller peripheral surface of each of the first and the second side roller members 58 and 59 has a part which is in the sorting passage 23.

After passing through the sorting position, the coin 20 rolls on the leg portion 51*a* with the selected end surface of the coin 20 sliding on the side roller peripheral surface of each of the first and the second side roller members 58 and 59. In this event, it is assumed that the unnecessary material adheres to the side roller peripheral surface of each of the first and the second side roller members 58 and 59. It is, however, readily possible to remove the unnecessary material from each of the first and the second side roller members 58 and 59 at the outside of the sorting passage 28. This is because each of the first and the second side roller members 58 and 59 is rotatable around the side roller axis.

Figure 11:
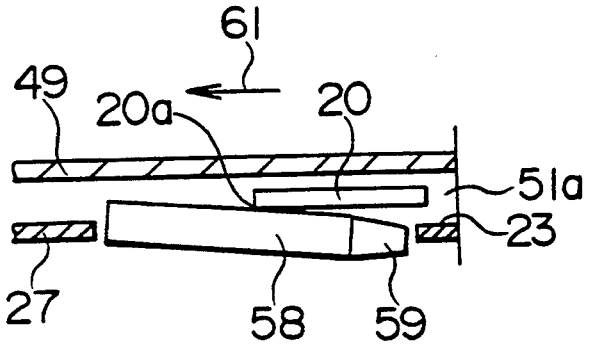
FIG. 11 is a sectional view of a main part of a first modification of the coin sorting device of FIG. 9.
Figure 12:
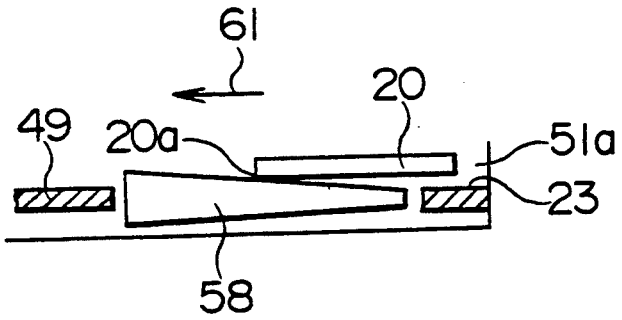
FIG. 12 is a sectional view of a main part of a second modification of the coin sorting device of FIG. 9.

Turning to FIGS. 11 and 12, the description will proceed to a first and a second modification of the coin sorting device of FIG. 10. Each of the first and the second modifications comprises similar parts designated by like reference numerals. Although the description will be directed only the first side roller member 58, the similar manner is applicable to the second side roller member 59.

In the first modification of FIG. 11, the first side roller member 58 is designed so that the side roller peripheral surface is cylindrical and that the side roller axis extends in a particular direction which makes a slight angle with the predetermined direction. It is to be noted in FIG. 11 that the coin 20 moves in a direction indicated by an arrow mark 61.

When rolled on the leg portion 51*a*, the coin 20 has a peripheral edge 20*a* which slides on the side roller peripheral surface of the first side roller member 58 to make the first side roller member 58 rotate around the side roller axis. Therefore, it is readily possible to remove the unnecessary material from the first side roller member 58 at the outside of the sorting passage 23.

In addition, a tapered portion 59 is formed integral with an axial end of the first side roller member 58. The tapered portion 59 is for preventing the coin 20 from becoming in engagement with the axial end of the first side roller member 58.

In the second modification of FIG. 12, the first side roller member 58 is designed so that the side roller peripheral surface is conical and that the side roller axis extends in the predetermined direction. With this constructure, the first side roller member 58 is rotated around the side roller axis when the coin rolls on the leg portion 51*a*. Therefore, it is readily possible to remove the unnecessary material from the first side roller member 58 at the outside of the sorting passage 23.

Figure 13:
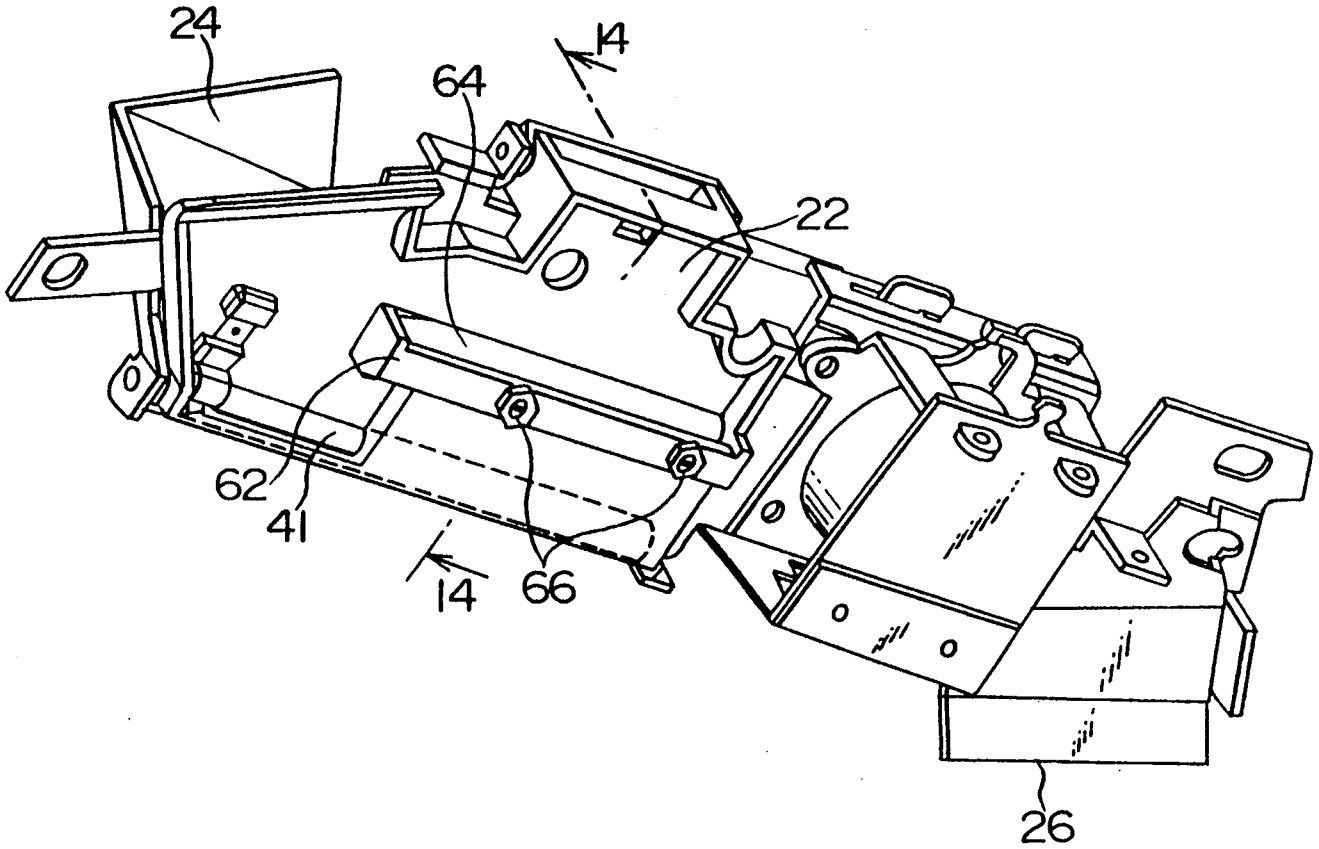
FIG. 13 is a perspective view of a coin sorting device according to a fifth embodiment of this invention.
Figure 14:
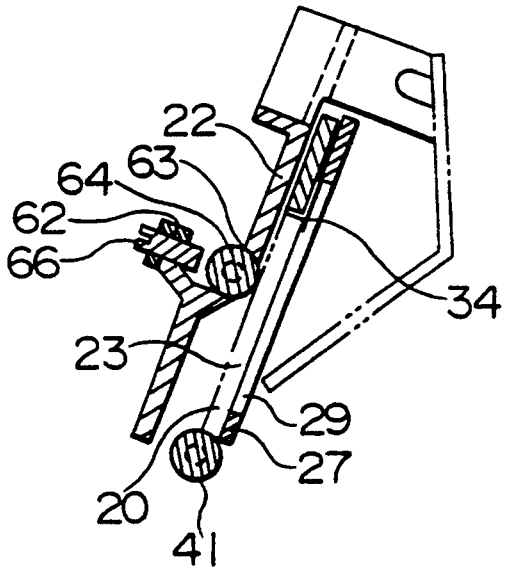
FIG. 14 is a sectional view of the coin sorting device taken along a line 14—14 in FIG. 13.

Turning to FIGS. 13 and 14, the description will proceed to a coin sorting device according to a fifth embodiment of this invention. The coin sorting device comprises similar parts designated by like reference numerals.

The movable plate 22 has a roller holding portion 62 and a specific window 63 in addition to the bottom roller member 41 at the sorting position. Each of the roller holding portion 62 and the specific window 63 extends in the predetermined direction.

The coin sorting device further comprises a specific side roller member 64 which is placed in the roller holding portion 62 to be movable in the specific direction.

The specific side roller member 64 is urged downwardly by its weight to face the specific window 63. The weight of the specific side roller member 64 will be referred to as an urging arrangement.

The specific side roller member 64 has a side roller axis and a side roller peripheral surface surrounding the side roller axis. It is to be noted that the side roller peripheral surface of the specific side roller member 64 has a part which is in the sorting passage 23 through the specific window 63.

For restricting movement of the specific side roller member 64 in the specific direction, the roller holding portion 62 has an adjusting screw member 66 which is opposite to the specific side roller member 64 in the specific direction. The adjusting screw member 66 has a position which is adjustable in the specific direction.

When supplied to the sorting position, the coin 20 is pushed towards the side portion 27 and the sorting plate 34 by the specific side roller member 64. As a result, suppression is carried out as regards movement, namely, shaking of the coin 20 in the specific direction. Therefore, the sorting operation can be reliably carried out at the sorting position.

In addition, it is assumed that the unnecessary material adheres to the side roller peripheral surface of the specific side roller member 64. It is, however, readily possible to remove the unnecessary material from the specific side roller member 64 at the outside of the sorting passage 23. This is because the specific side roller member 64 is rotatable around the side roller axis thereof.

While the present invention has thus far been described in connection with only a few embodiments thereof, it will readily be possible for those skilled in the art to put this invention into practice in various other manners. For example, the sorting operation can be carried out by various manners which are not illustrated. The coin sorting device can deal with a normal coin, the taken coin, or the like as the coin. It is a matter of course that the coin sorting device is useful in an automatic vending machine, a coin operated gaming machine, or the like.

What is claimed is:

1. A coin sorting device comprising:

passage means defining a sorting passage and having a side portion defining one side of said sorting passage and a bottom portion to guide a coin in a predetermined direction, sorting means cooperatively associated with said passage means for carrying out a sorting operation for said coin; and removing means for removing unnecessary material from said coin, said removing means comprising a side roller member connected to said passage means, said side roller member being cylindrically shaped and having a side roller axis and a side roller peripheral surface surrounding said side roller axis, with at a least a portion of said peripheral surface conically shaped, said side roller peripheral surface being partly disposed in said sorting passage.

2. A coin sorting device as claimed in claim 1, wherein said side roller member is supported against said side portion.

3. A coin sorting device as claimed in claim 2, wherein said side roller axis extends in said predetermined direction.

4. A coin sorting device as claimed in claim 2, wherein said side roller peripheral surface is conical along its whole length.

5. A coin sorting device as claimed in claim 2, wherein said side roller axis extends in a selected direction and at a predetermined angle with said predetermined direction.

6. A coin sorting device as claimed in claim 1, wherein said passage defining means further comprises:

a movable plate movably connected to said sorting passage for defining the other side of said sorting passage.

7. A coin sorting device as claimed in claim 6, wherein said side roller member is supported against said movable plate.

8. A coin sorting device as claimed in claim 7, wherein said side roller member is movable in a specific direction perpendicular to said movable plate.

9. A coin sorting device as claimed in claim 8, further comprising means for urging said side roller member towards said sorting passage in said specific direction.

10. A coin sorting device comprising:

passage means defining a sorting passage and having a side portion defining one side of said sorting passage and a bottom portion to guide a coin in a predetermined direction;

sorting means cooperatively associated with said passage means for carrying out a sorting operation for said coin; and removing means for removing unnecessary material from said coin, said removing means comprising a side roller member connected to said passage means, said side roller member being supported against said side portion and having a side roller axis extending in said predetermined direction and a side roller peripheral surface surrounding said side roller axis, said side roller peripheral surface being conical and being partly disposed in said sorting passage.

* * * * *